US005092069A

United States Patent [19]

Walker

[11] Patent Number: 5,092,069

[45] Date of Patent: Mar. 3, 1992

[54] FIREARM

[75] Inventor: Hilton R. Walker, Winston Park, South Africa

[73] Assignee: Hoffmann Walker Product Developers CC, Johannesburg, South Africa

[21] Appl. No.: 719,781

[22] Filed: Jun. 24, 1991

[30] Foreign Application Priority Data

Jun. 26, 1990 [ZA] South Africa ..... 90/4968

[51] Int. Cl.[5] ..... F41C 3/14

[52] U.S. Cl. ..... 42/59; 42/67

[58] Field of Search ..... 42/59, 65, 67; 89/160

[56] References Cited

U.S. PATENT DOCUMENTS

| | | | |
|---|---|---|---|
| 700,592 | 5/1902 | Whiting | 42/59 |
| 1,077,135 | 10/1913 | Guerrero | 42/59 |
| 2,835,171 | 5/1958 | Lyon | 89/160 |
| 4,581,835 | 4/1986 | Brouthers et al. | 42/65 |
| 4,694,602 | 9/1987 | Pust | 42/59 |

*Primary Examiner*—Michael J. Carone
*Attorney, Agent, or Firm*—Ladas & Parry

[57] ABSTRACT

A firearm is disclosed comprising a frame, a firing mechanism mounted on the frame, and a barrel mounted on the frame having a longitudinal axis aligned with the firing mechanism. A drum magazine is mounted for rotation about a central axis on the frame, the magazine having a plurality of circumferentially spaced cartridge chambers, each chamber being positioned so that when rotated into an appropriate position it registers with the firing mechanism and the barrel. A shroud is circumferentially mounted over the barrel and is rotatable with respect thereto. An indexing means is operable by means of a to-and-fro relative rotation between the shroud and the frame, to rotate the drum magazine from a fire position which a said cartridge chamber registers with the firing mechanism to a next succeeding fire position in which a next succeeding cartridge chamber registers with the firing mechanism.

11 Claims, 3 Drawing Sheets

FIREARM

This invention relates to a firearm. More particularly this invention relates to a firearm comprising a drum magazine rotatably mounted on a frame and having indexing means for aligning circumferentially spaced cartridge chambers of the magazine with a barrel and with a cartridge firing mechanism of the firearm.

The only firearms having drum magazines, of which the Applicant is aware, are either automatic or semi-automatic firearms. However for many different applications of firearms, automatic and semi-automatic firearms are not permitted. In this invention a firearm having a drum magazine is disclosed which is not an automatic firearm. The firearm does however permit of rapid firing of consecutive cartridges through quick manual operation of the indexing means.

According to this invention there is provided a firearm comprising:

- a frame;
- a firing mechanism mounted on the frame;
- a barrel mounted on the frame, having a longitudinal axis axially aligned with the firing mechanism;
- a drum magazine mounted for rotation about a central axis on the frame, the magazine having a plurality of circumferentially spaced cartridge chambers extending in a circle around said central axis, each cartridge chamber being positioned so that when rotated into an appropriate position it registers with the firing mechanism and the barrel;
- a shroud circumferentially mounted over the barrel and rotatable with respect thereto; and
- an indexing means operable by means of a to-and-fro relative rotation between the shroud and the frame, to rotate the drum magazine from a fire position in which a said cartridge chamber registers with the firing mechanism to a next succeeding fire position in which a next succeeding cartridge chamber registers with the firing mechanism.

The indexing means may comprise a continuous elongate groove formation defined in the drum magazine, having a plurality of pairs of groove formation segments each extending between an outer circular line and an inner circular line, each pair of segments comprising a first segment which extends from an outer position on the outer circular line to an inner position on the inner circular line and a second segment which extends from said inner position to a next succeeding outer position, on the outer circular line; and a guide member secured to the shroud and engaging said groove formation, which on a said to-and-fro rotation of the shroud relative to the frame is displaced along a pair of segments of the groove formation from an outer position to a next succeeding outer position thereby effecting rotation of the magazine from said fire position to a next succeeding fire position.

The groove formation may be defined in an end of an indexing plate secured to form a part of the drum magazine.

The firearm may include a locating means for locating the guide member at each said outer position of the groove formation, each said outer position corresponding to a fire position of the magazine.

The guide member may be biassed by biassing means into engagement with a base of the groove formation.

The locating means may include a recess formation in the base of the groove formation at each said outer position, within which said guide member is received thereby locating said guide member and positioning the magazine in a fire position.

The base of the groove formation may include a plurality of step discontinuities at the inner and outer positions of each groove segment against which the guide member cannot be displaced and thereby providing for unidirectional displacement of the guide member in the groove formation.

The firearm may include backstop locating means for assisting in locating the guide member at each said outer position of the groove formation and thereby positioning the magazine in a fire position.

The backstop locating means may comprise a backstop locating element operatively coupled to the shroud having biassing means for biassing it outwardly away from the shroud into engagement with the frame; and a backstop locating recess formation defined in the frame and positioned so that when the backstop locating element is received therein, the guide member is positioned in a said outer position and the magazine is positioned in a fire position.

The firearm may include further biassing means urging the shroud to rotate in a predetermined direction relative to the barrel, said urging tending to locate the guide member at a said outer position of the groove formation and hence tending to position the magazine in a fire position.

The firearm may include a handle formation rigidly mounted to the shroud and projecting outwardly away therefrom for facilitating rotation thereof relative to the frame.

Two embodiments of the invention will now be described, by way of example, with reference to the accompanying diagrammatic drawings, in which.

Figure 6:
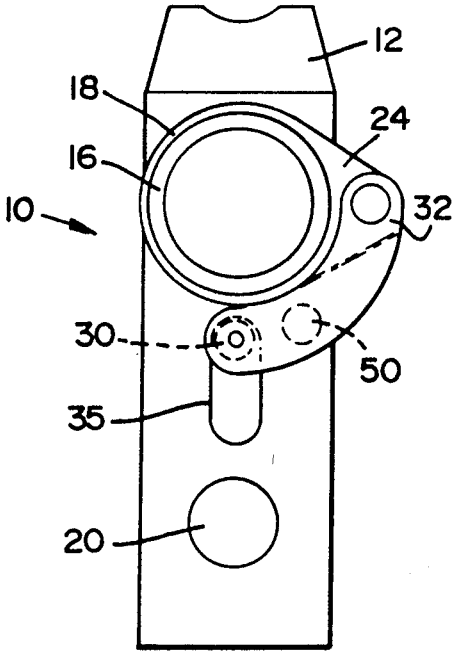
FIG. 6 shows a front view, showing hidden detail, of a part of an indexing means of a firearm in accordance with a second embodiment of the invention, in a fire position (some details omitted for clarity)
Figure 7:
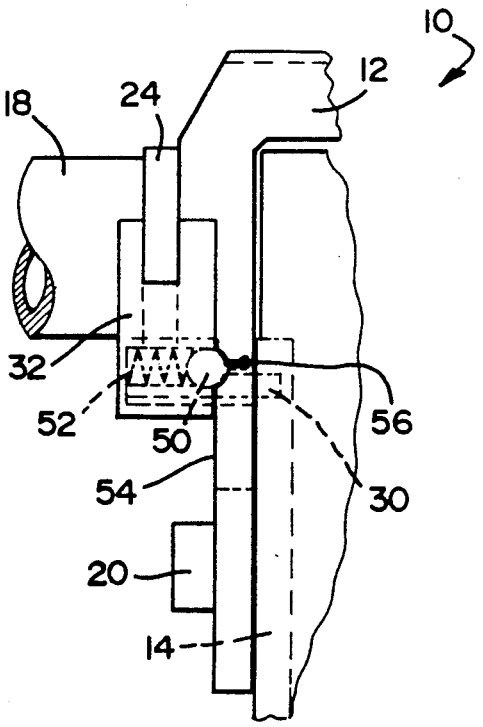
FIG. 7 shows a side view, showing hidden detail, of a part of the indexing means of the portion of the firearm of FIG. 6, in a fire position (some details omitted for clarity)
Figure 8:
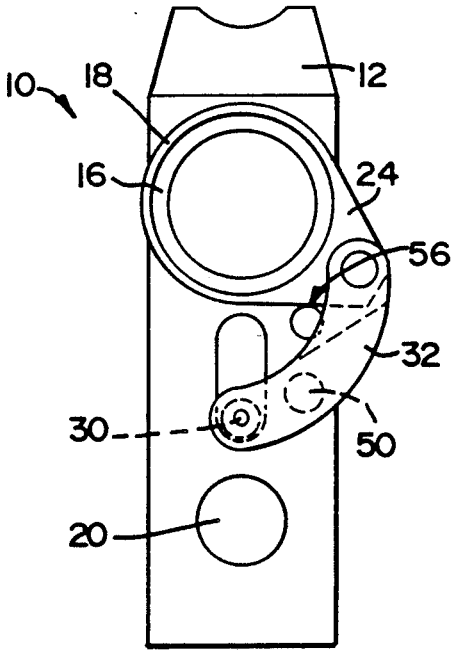
Figure 9:
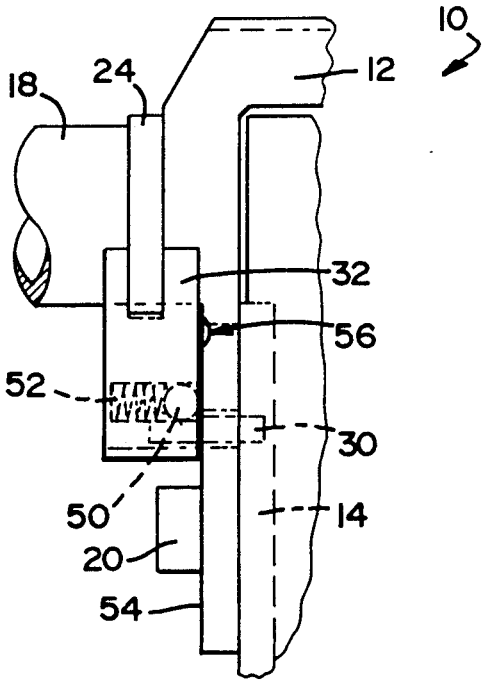

FIG. 8 shows a front view showing hidden detail, of a part of the indexing means of the firearm of FIG. 6, in a position intermediate successive firing positions (some details omitted for clarity); and FIG. 9 shows a side view, showing hidden detail, of a part of the indexing means of the firearm of FIG. 6, also in a position intermediate successive firing positions (some details omitted for clarity).

Referring to FIGS. 1 to 5, reference numeral 10 designates generally a part of a firearm, in accordance with the invention.

The part of the firearm 10 includes a frame 12, a rotatable drum magazine 14, a barrel 16 extending from the frame 12, and a shroud 18 surrounding the barrel 16.

The rotatable drum magazine 14 is rotatably mounted on the frame 12 by means of a centre shaft 20. Rotation of the magazine 14 with respect of the frame 12, permits successive cartridge chambers 22 within the magazine 14, to be consecutively aligned or registered with a firing mechanism (not shown) and with the barrel 16.

The general configuration of the frame 12, the magazine 14 and the barrel 16, is essentially conventional, as is known for firearms of the general type, and therefore is not described in any further detail herein.

The firearm 10 further includes an indexing means which includes an indexing plate 26 that is secured to form part of the magazine 14, the plate 26 defining a continuous elongate groove formation 28 extending around an axis defined by the centre shaft 20.

The groove formation 28 comprises a plurality of pairs of groove segments 38 extending between an outer circular line 40 and an inner circular line 42. Each pair of groove segments 38 comprises a first segment which extends from an outer position located on the outer circular line 40 to an inner position located on the inner circular line 42, and a second segment which extends from said inner position to a further radially outer position located on the outer circular line 40, and spaced from said one outer position.

The indexing means further includes a guide member which is a guide pin 30 located within a pin holder 32.

The pin holder 32 is coupled to the shroud 18 by means of a locating plate which is a push plate 24. The push plate 24 is rigidly secured to the shroud 18 whereas the pin holder 32 is coupled, pivotally to some extent, to said push plate 24. Displacement of the pin holder 32, and thereby also the guide pin 30, relative to the frame 12, is guided by means of a slot aperture 35 in the frame 12, through which the guide pin 30 projects.

The pivotal movement of the push plate 24 is translated into translated into translational displacement of the guide pin 30 along the slot aperture 35, which displaces the guide pin 30 along the pairs of groove segments 38 between the spaced circular lines 40, 42 described above.

A biassing means which is a spring 34 is located within the pin holder 32 and acts on the guide pin 30 urging the pin 30 into engagement with a base of the groove formation 28.

A handle formation which is a handle grip 36 is secured to and extends from the shroud 18, the grip 36 facilitating relative manual rotation of the shroud 18 of the firearm 10 with respect to the frame 12, for the purpose hereinafter described. As is described above and as is also clear from FIG. 4 of the drawings, the groove formation 28 includes a plurality of pairs of groove segments 38, the number of pairs of groove segments 38 coinciding with the number of cartridge chambers 22 defined in the magazine 14.

Figure 1:
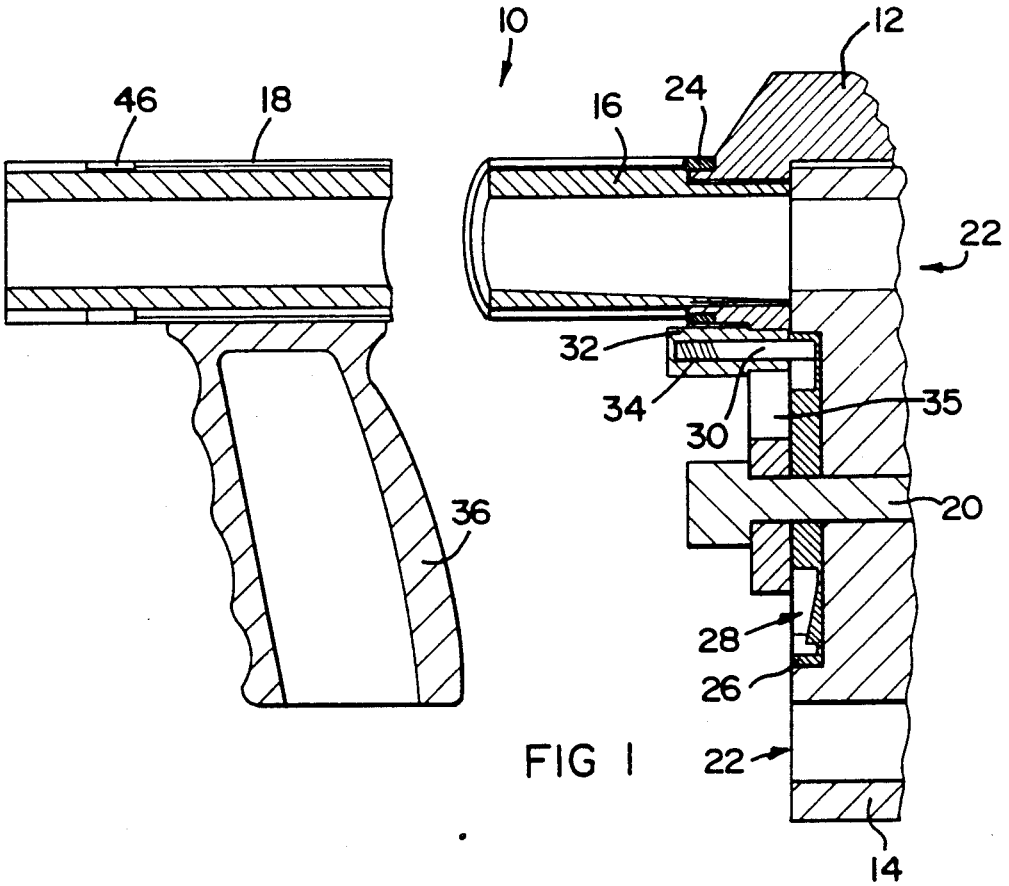
FIG. 1 shows a partially sectioned side view of a portion of a firearm, in accordance with a first embodiment of the invention.
Figure 2:
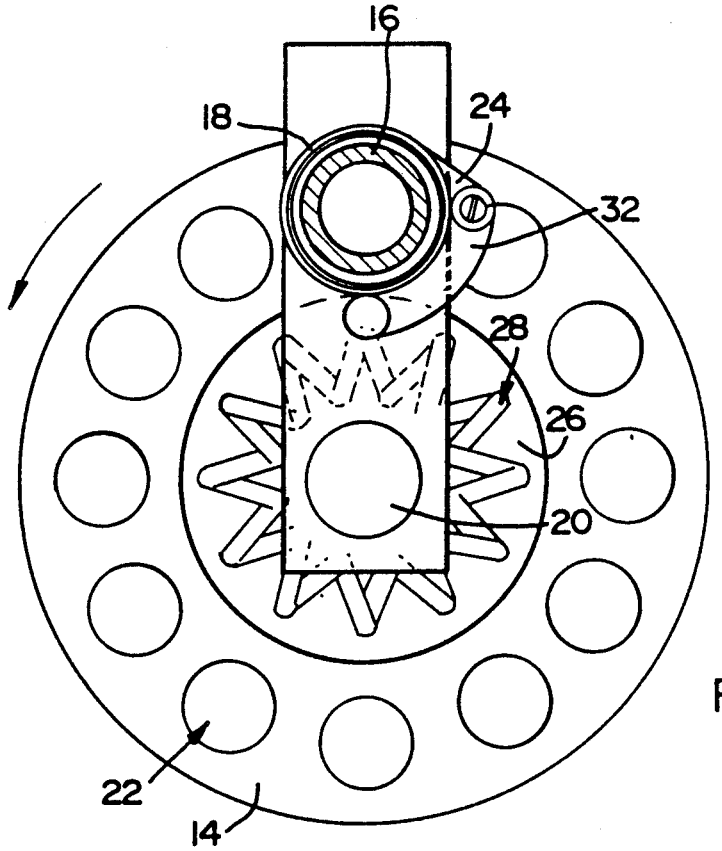
FIG. 2 shows an elevational front view of the magazine and indexing means of the firearm of FIG. 1.
Figure 3:
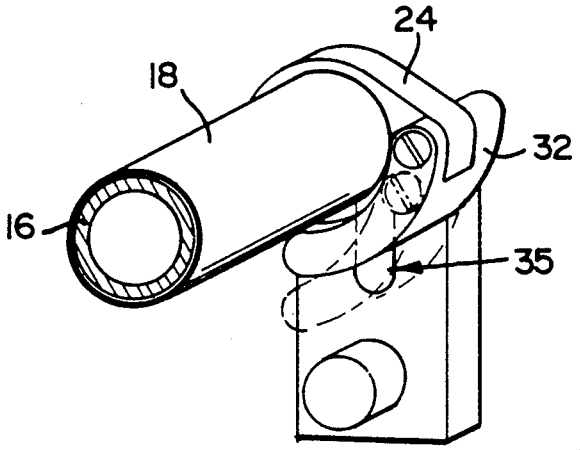
FIG. 3 shows a three-dimensional view of a part of the indexing means of the firearm of FIG. 1.
Figure 4:
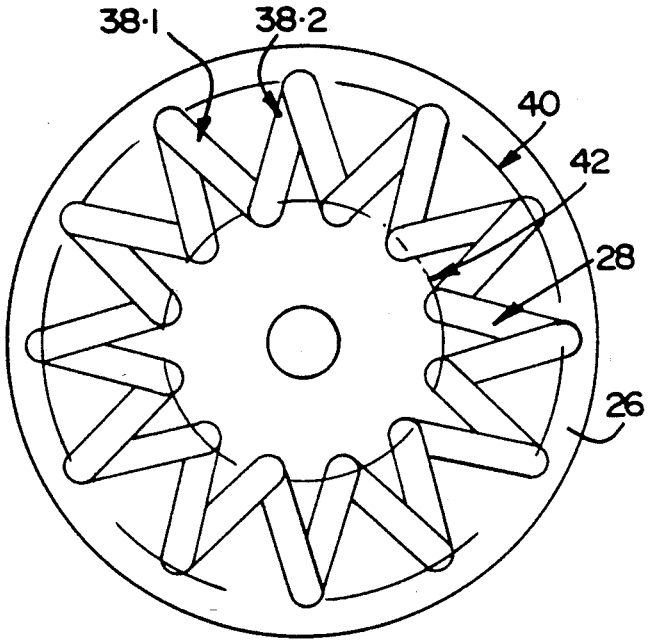
FIG. 4 shows a front view of another part of the indexing means of the firearm of FIG. 1.
Figure 5:
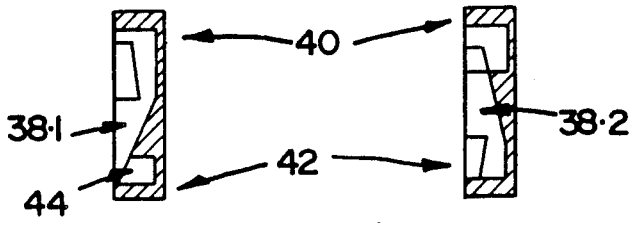
FIG. 5 illustrates the depth profile of individual groove segments defined in an indexing plate forming part of the indexing means shown in FIG. 4.

The depth profile of each pair of groove segments 38 is illustrated in FIG. 5 of the drawings, the depth profile of the segment 38.1 being such that the depth of the groove formation 38.1 decreases from its end coinciding with the outer circular line 40 towards the inner circular line 42, a sudden increase in depth occurring at the end coinciding with the inner circular line 42, so that the urging force of the spring 34 will click the guide pin 30 into a recess formation 44 defined in the base of the groove formation 28. The depth of the segment 38.2 of the groove formation in the region of the inner circular line 42 therefore is relatively deep with the depth decreasing towards the circular line 40, except insofar as a similar recess formation is defined in the base of the groove formation 28 at the point thereof coinciding with the outer circular line 40.

In a fire position of the firearm 10, in which a cartridge chamber 22 of the magazine 14 is aligned with and registers with the firing mechanism of the firearm, the guide pin 30 will be located at an outer position of a groove segment 38.1 that coincides with the outer circular line 40. On relative rotation of the shroud 18 with respect to the frame 12, the guide pin 30 will be displaced along the groove segment 38.1 towards its inner position coinciding with the inner circular line 42, hereinafter referred to as the midway position. This displacement of the guide pin 30 causes the guide pin 30 to act on the indexing plate 26 and therefore the magazine 14, rotating it through a half rotation between successive firing positions in which successive cartridge chambers are aligned with the firing mechanism of the firearm. When said midway position is reached, reverse rotation of the shroud 18 relative to the frame 12 occurs, during which the guide pin 30 is displaced along a groove segment 38.2 from an inner position of the groove segment 38.2 to an outer position of the groove segment 38.2, coinciding with the outer line 40, which is circumferentially spaced from the outer position corresponding to groove segment 38.1. This will cause further rotation of the magazine 14 until the next cartridge chamber 22 in the magazine 14 is aligned or registered with the firing mechanism.

A further biassing means which comprises a spring 46 acts between the shroud 18 and the barrel 16, effectively urging the shroud 18 into a position with respect to the frame 12 in which the magazine 14 will be in a firing position. As such, initial rotation of the shroud 18 with respect to the frame 12 is effected by manual rotation of the shroud 18 against the force of the spring 46, whereas reverse rotation is effected by the force of the spring 46, the force of the spring 46 being sufficient to ensure that full rotation of the magazine 14 occurs so that the next succeeding cartridge chamber 22 is properly aligned with the firing mechanism of the firearm. Therefore, the spring 46 effectively urges the guide pin 30 into an outer position in the groove formation 28 in the indexing plate 26.

A second embodiment of the invention will now be described with reference to FIGS. 6 to 9. In FIGS. 6 to 9 the same reference numerals refer to the same components as in FIGS. 1 to 5, unless otherwise specified.

The second embodiment of the firearm is similar to the first embodiment of the firearm, the principal difference being that the second embodiment has a backstop locating means for assisting in locating the guide pin 30 in a said outer position of the groove formation 28 and thereby locating the magazine 14 in a fire position.

The backstop locating means comprises a backstop locating element which is a ball 50 operatively coupled to the shroud by means of a spring 52. The ball 50 is biassed into engagement with a wall 54 of the frame 12 which extends downwardly over a leading end of the magazine 14. A backstop locating recess, which is a dimple 56, is defined in the wall 54 in a position such that when the ball 50 clicks into and is received in the dimple 56, the guide pin 30 will be located in an outer position and the magazine 14 positioned in a fire position.

Thus the backstop locating means serve to assist a user in ensuring that the magazine is in a fire position with a cartridge chamber 22 in alignment with and registering with the barrel 16 prior to firing the firearm 10.

In this embodiment the firearm does not have a spring tending to rotate the shroud 18 relative to the barrel 16 in a predetermined direction. Thus the to-and-fro rotation of the shroud 18 relative to the frame 16 is achieved solely by manual means.

In use, the firearm will be used in much the same manner as for the first embodiment. When preparing the firearm to fire by rotating the magazine between successive firing positions, clicking the ball 50 into the dimple 56, will ensure that a cartridge chamber 22 is properly registered with the firing mechanism and barrel 16.

Although the firearm 10 is associated with a drum magazine, because of the mode of advance of the magazine, the gun cannot be described as an automatic firearm or a semi-automatic firearm, which will render it useful for many different applications for which automatic and semi-automatic firearms are not permitted. The operation of the indexing means also is such that rapid firing of consecutive cartridges can occur through quick manual operation of the indexing means, which is effected by the relative rotation of the firearm shroud 18 with respect to the frame 12.

The mode of indexing as described above clearly is greatly variable and the invention extends also to a firearm of the above type which permits indexing incorporating the principles as are hereinabove described.

I claim:

1. A firearm comprising:

a frame;

a firing mechanism mounted on the frame;

a barrel mounted on the frame, having a longitudinal axis axially aligned with the firing mechanism;

a drum magazine mounted for rotation about a central axis on the frame, the magazine having a plurality of circumferentially spaced cartridge chambers extending in a circle around said central axis, each cartridge chamber being positioned so that when rotated into an appropriate position it registers with the firing mechanism and the barrel;

a shroud circumferentially mounted over the barrel and rotatable with respect thereto; and an indexing means operable by means of a to-and-fro relative rotation between the shroud and the frame, to rotate the drum magazine from a fire position in which a said cartridge chamber registers with the firing mechanism to a next succeeding fire position in which a next succeeding cartridge chamber registers with the firing mechanism.

2. A firearm according to claim 1, in which the indexing means comprises a continuous elongate groove formation defined in the drum magazine, having a plurality of pairs of groove formation segments each extending between an outer circular line and an inner circular line, each pair of segments comprising a first segment which extends from an outer position on the outer circular line to an inner position on the inner circular line and a second segment which extends from said inner position to a next succeeding outer position, on the outer circular line; and a guide member secured to the shroud and engaging said groove formation, which on a said to-and-fro rotation of the shroud relative to the frame is displaced along a pair of segmetns of the groove formation from an outer position to a next succeeding outer position thereby effecting rotation of the magazine from said fire position to a next succeeding fire position.

3. A firearm according to claim 2, in which the groove formation is defined in an end of an indexing plate secured to form a part of the drum magazine.

4. A firearm according to claim 3, which includes locating means for locating the guide member at each said outer position of the groove formation, each said outer position corresponding to a fire position of the magazine.

5. A firearm according to claim 4, in which the guide member is biassed by biassing means into engagement with a base of the groove formation.

6. A firearm according to claim 5, in which the locating means includes a recess formation in the base of the of the groove formation at each said outer position, within which said guide member is received thereby locating said guide member and positioning the magazine in a fire position.

7. A firearm according to claim 5, in which the base of the groove formation includes a plurality of step discontinuities at the inner and outer positions of each groove segment against which the guide member cannot be displaced and thereby providing for unidirectional displacement of the guide member in the groove formation.

8. A firearm according to claim 6, which includes backstop locating means for assisting in locating the guide member at each said outer position of the groove formation and thereby positioning the magazine in a fire position.

9. A firearm according to claim 8, in which the backstop locating means comprises a backstop locating element operatively coupled to the shroud having biassing means for biassing it outwardly away from the shroud into engagement with the frame; and a backstop locating recess formation defined in the frame and positioned so that when the backstop locating element is received therein, the guide member is positioned in a said outer position and the magazine is positioned in a fire position.

10. A firearm according to claim 5, which includes further biassing means urging the shroud to rotate in a predetermined direction relative to the barrel, said urging tending to locate the guide member at a said outer position of the groove formation and hence tending to position the magazine in a fire position.

11. A firearm according to claim 1, which includes a handle formation rigidly mounted to the shroud and projecting outwardly away therefrom for facilitating rotation thereof relative to the frame.

* * * * *